US010343799B2

(12) United States Patent
Thomas et al.

(10) Patent No.: US 10,343,799 B2
(45) Date of Patent: Jul. 9, 2019

(54) TRIGGERLESS CABLE TIE TENSION AND CUT TOOL

(71) Applicant: The Boeing Company, Chicago, IL (US)

(72) Inventors: Daniel S. Thomas, Summerville, SC (US); David Carbon, Mt. Pleasant, SC (US); Daniel P. Mooney, Daniel Island, SC (US)

(73) Assignee: The Boeing Company, Chicago, IL (US)

( * ) Notice: Subject to any disclaimer, the term of this patent is extended or adjusted under 35 U.S.C. 154(b) by 410 days.

(21) Appl. No.: 15/420,473

(22) Filed: Jan. 31, 2017

(65) Prior Publication Data

US 2018/0215487 A1 Aug. 2, 2018

(51) Int. Cl.

| | |
|---|---|
| ***B65B 13/02*** | (2006.01) |
| ***B26D 7/08*** | (2006.01) |
| ***B26D 7/14*** | (2006.01) |

(52) U.S. Cl.

CPC ..... *B65B 13/027* (2013.01); *B26D 7/08* (2013.01); *B26D 7/14* (2013.01)

(58) Field of Classification Search

CPC ..... B65B 13/025; B65B 13/027

See application file for complete search history.

(56) References Cited

U.S. PATENT DOCUMENTS

| | | | | |
|---|---|---|---|---|
| 3,254,660 | A | 6/1966 | Caveney et al. | |
| 3,438,406 | A | 4/1969 | Rozmus | |
| 3,865,156 | A * | 2/1975 | Moody | B65B 13/027 140/123.6 |
| 4,495,972 | A | 1/1985 | Walker | |
| 4,498,506 | A * | 2/1985 | Moody | B65B 13/027 140/93 A |
| 4,640,320 | A | 2/1987 | Avison et al. | |
| 5,312,410 | A | 5/1994 | Miller et al. | |
| 5,769,133 | A * | 6/1998 | Dyer | B65B 13/027 140/123.6 |
| 7,124,787 | B2 | 10/2006 | Lueschen | |
| 2005/0005993 | A1 * | 1/2005 | Magno, Jr. | B65B 13/027 140/123.6 |

* cited by examiner

*Primary Examiner* — Shelley M Self
*Assistant Examiner* — Jared O Brown
(74) *Attorney, Agent, or Firm* — Joseph M. Rolnicki; Evans & Dixon, L.L.C.

(57) ABSTRACT

A tool for installing a cable tie has an axial length with no hand grip or trigger projecting laterally from the length of the tool and the tool is activated electronically by a push button to pull the tail of the cable tie and then cut the tail from the cable tie adjacent the head of the cable tie.

18 Claims, 4 Drawing Sheets

TRIGGERLESS CABLE TIE TENSION AND CUT TOOL

FIELD

This disclosure pertains to a tool for installing a cable tie having a head and a tail extending from the head. More specifically, this disclosure pertains to a tool for installing a cable tie where the tool has a longitudinal length with no hand grip or trigger projecting laterally from the longitudinal length of the tool and the tool is activated electronically by a push button to pull the tail of the cable tie and then cut the tail from the cable tie adjacent the head of the cable tie.

BACKGROUND

Cable ties are often used in bundling together groups of wires and/or wiring harnesses in many manufacturing procedures, for example in the manufacturing of aircraft. In the manufacturing of aircraft, zip ties or cable ties are used for securing together bundles of wiring throughout the interior of the aircraft.

The typical cable tie comprises a ratchet head and a length of strap or a tail extending from the ratchet head. The ratchet head includes an open passage through the ratchet head and a resilient pawl inside the open passage. The tail includes a plurality of teeth or a rack extending along the length of one side of the tail. The rack engages the pawl as the tail is extended through the passage of the ratchet head. The pawl prevents the tail from being withdrawn from the passage through the ratchet head.

When attaching a cable tie around a bundle of wiring, the tail of the cable tie is wrapped around the bundle of wiring and then inserted through the cable tie head. Cable ties are generally installed around the wire bundles and loosely attached to a surface of the aircraft interior by hand. Once all of the cable ties are in place on a length of bundled wiring in a particular area or section of the aircraft interior, the technician installing the cable ties uses a tensioning and cutting gun on each of the ties to bring the ties to a specified tension and to cut off the excess length of the tail extending from the ratchet head.

Occasionally, after the tail has been cut, a portion of the tail will extend beyond the ratchet head. This can occur if excess slack in the tail is not removed from the cable tie prior to use of the tensioning and cutting gun. The portion of the tail extending from the head is typically sharp and may cause damage to adjacent components of the aircraft construction. Additionally, the sharp, projecting portion of the tail may cause an injury to a technician that comes in contact with the sharp portion of the tail projecting from the head.

A typical cable tie tensioning and cutting gun has a trigger pivotally coupled to the gun for applying a predetermined tensile force to the tail of the cable tie when tightening the cable tie around a bundle of wiring. With the cable tie attached around the bundle of wiring, the tail projecting from the head of the cable tie is inserted into an end of the gun. The trigger of the gun is squeezed by the technician and the gun pulls the tail from the head of the cable tie and applies a predetermined force to the tail. In applying cable ties to bundles of wiring in the manufacturing of aircraft, it is often necessary that the squeezing motion on the trigger of the gun be repeated many times for each bundle of wiring. A typical shift in the manufacturing of aircraft could see a technician squeezing a gun trigger several thousand times. This presents a major ergonomic concern. Additionally, as the trigger of the gun is squeezed by the technician and rotates about a pivot pin attaching the trigger to the gun, a pinching point is creating between the body of the gun and the trigger. This pinching point may unintentionally cut and/or crimp other wires adjacent the cable tie location.

SUMMARY

The ergonomic disadvantage of having to squeeze a trigger on a cable tie tensioning and cutting gun possibly several thousand times during a manufacturing shift is eliminated by the cable tie tension and cutting tool of this disclosure, which has no trigger. The elimination of the trigger also eliminates the problem of wiring becoming pinched between a trigger and gun body. Also, the sharp tail portion projecting from the head of the cable tie not having all of the slack taken out of the cable tie before the tail is cut and is eliminated by the construction of the tool that is the subject of this disclosure.

The tool has an elongate body. An exterior wall of the body surrounds an interior of the tool. The exterior wall has a cylindrical configuration and a center axis that defines mutually perpendicular axial and radial directions relative to the tool. The exterior wall has an axial length that extends between a proximal end of the wall that defines the proximal end of the body and a distal end of the wall that defines a distal end of the body.

A solenoid is contained in the body. The solenoid is comprised of a solenoid shaft and a solenoid coil that surrounds the solenoid shaft. The solenoid shaft is axially moveable in the interior of the body toward the distal end of the body to a first position of the solenoid shaft relative to the body, and toward the proximal end of the body to a second position of the solenoid shaft relative to the body. A spring biases the solenoid shaft toward the first position of the solenoid shaft relative to the body.

A power source is connected to the body. The power source is comprised of a rechargeable battery contained in a battery housing. The battery housing is removably attached to the body at the proximal end of the body.

A cable tie tension and cut device is attached to the body. The cable tie tension and cut device can be any known cable tie tension and cut device that can manually receive the tail of a cable tie that has been inserted through the head of the cable tie, and is operable to pull or tension the tail of the cable tie and then cut the tail of the cable tie adjacent the head of the cable tie. The cable tie tension and cut device is operable to tension the tail of the cable tie and then cut the tail of the cable tie in response to a shaft or rod of the cable tie tension and cut device being moved axially from a position adjacent the distal end of the body toward the proximal end of the body. The rod of the cable tie tension and cut device is operatively connected to the solenoid shaft.

A switch is provided inside the body. The switch is operatively, electrically connected to the power source and the solenoid coil. The switch is operable whereby, on closing the switch, electric power from the power source is communicated through the switch to the coil of a solenoid, causing the coil of the solenoid to move the solenoid shaft from the first position of the solenoid shaft to the second position of the solenoid shaft. In one embodiment of the tool the switch is positioned inside the body adjacent the rod of the cable tie tension and cut device. In a further embodiment of the tool the switch is positioned inside the body adjacent an opening through the body whereby the switch can be accessed and closed manually by pressing laterally on an actuator of the switch.

In operation of the tool, with the tail of the cable tie wrapped around a bundle of wiring and inserted through the head of the cable tie and into the cable tie tension and cut device, the cable tie tension and cut device at the distal end of the body is pressed against the head of the cable tie. Manually pushing the cable tie tension and cut device against the head of the cable tie while manually holding the tail of the cable tie removes any slack in the tail of the cable tie. Continued manually pushing of the cable tie tension and cut device against the head of the cable tie causes the rod to move from the first position of the rod toward the proximal end of the body. The tool is continued to be pushed against the head of the cable tie and the rod continues to move toward the proximal end of the body until the rod comes into contact with the switch actuator, closing the switch. Closing the switch provides power to the solenoid coil which causes the solenoid shaft to move from its first position to its second position. The movement of the solenoid shaft moves the rod of the cable tie tension and cut device which activates the cable tie tension and cut device to pull the cable tie tail from the cable tie head at a predetermined force, and then cut the cable tie tail adjacent the cable tie head.

In the further embodiment of the tool having the switch accessible from the exterior of the body of the tool, the switch is manually pressed laterally relative to the body of the tool closing the switch. Again, closing the switch provides power to the solenoid coil which causes the solenoid shaft to move from its first position to its second position which in turn activates the cable tie tension and cut device to pull the cable tie tail from the cable tie head and then cut the cable tie tail adjacent the cable tie head.

BRIEF DESCRIPTION OF THE DRAWINGS

Further features of the tool for installing a cable tie are set forth in the following detailed description of the tool and the drawing figures.

DETAILED DESCRIPTION

Figure 1:
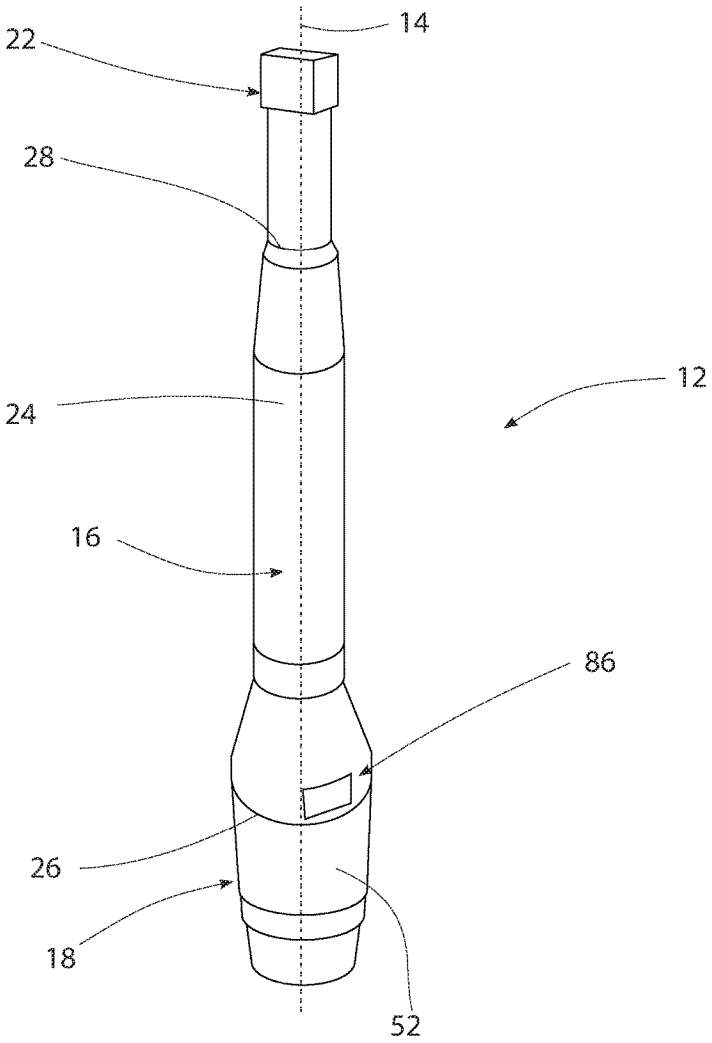
FIG. 1 is a representation of a perspective view of the tool.

FIG. 1 is a representation of the exterior of the cable tie tension and cut tool 12. The component parts of the tool 12 to be described are symmetric around a center axis 14 of the tool. Therefore, only one side of the tool 12 is represented in FIG. 1. It should be understood that the appearance of the tool 12 around the center axis 14 is substantially the same. The tool 12 is comprised of basically three component parts. The tool 12 includes a body 16, a power source 18 and a cable tie tension and cut device 22. The component parts of the body 16, the power source 18, and the cable tie tension and cut device 22 are constructed of materials such as plastics and/or metals that provide the tool 12 with sufficient strength for its intended functioning.

The body 16 is elongate and has an exterior wall 24 that surrounds an interior of the tool 12. The exterior wall 24 has a cylindrical configuration around the center axis 14. The center axis 14 defines mutually perpendicular axial and radial directions relative to the body 16 and relative to the tool 12. The cylindrical axial length of the exterior wall 24 extends between a proximal end 26 of the wall that defines a proximal end of the body and a distal end 28 of the wall that defines a distal end of the body.

Figure 2:
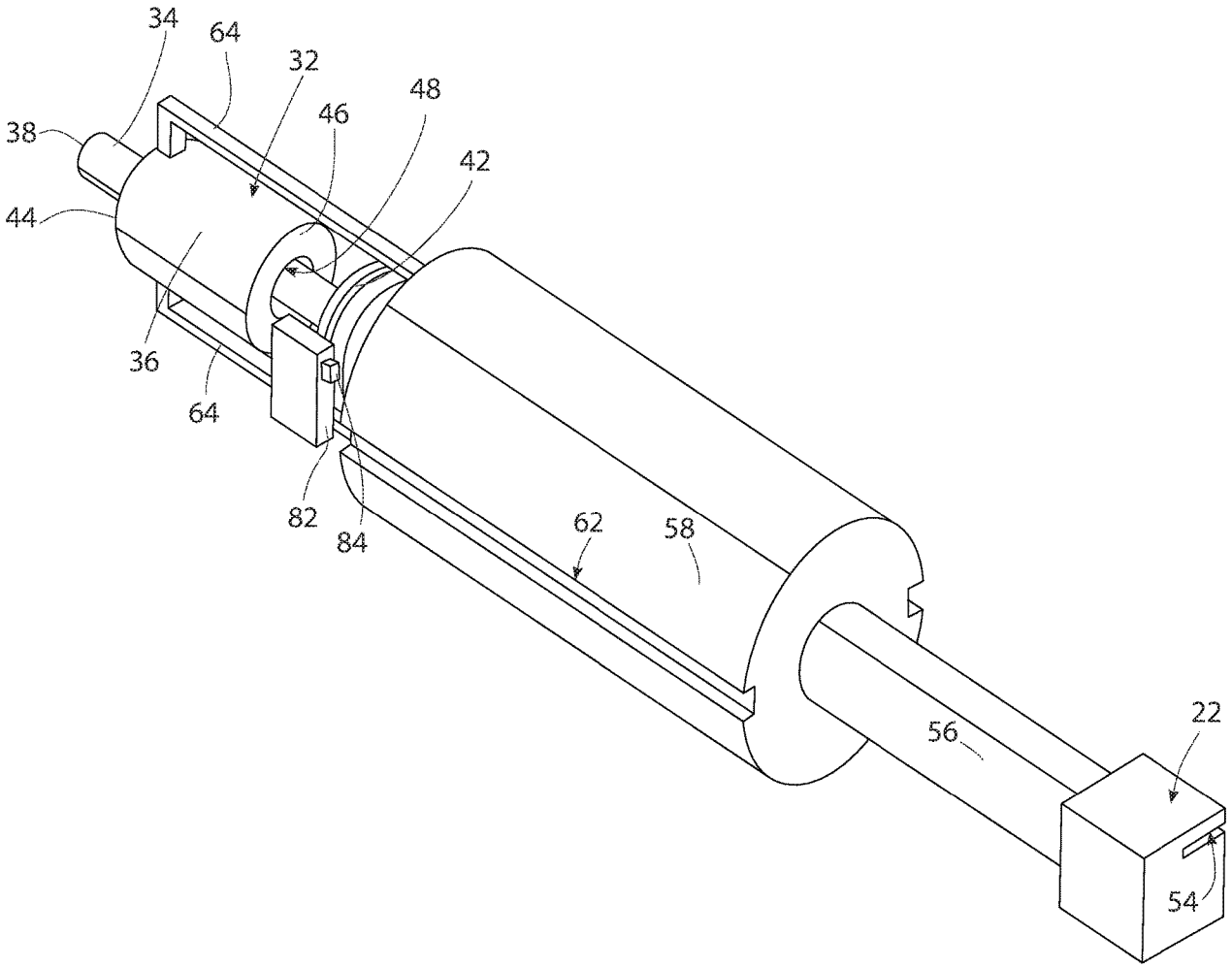
FIG. 2 is a representation of a perspective view of the interior of the tool.
Figure 3:
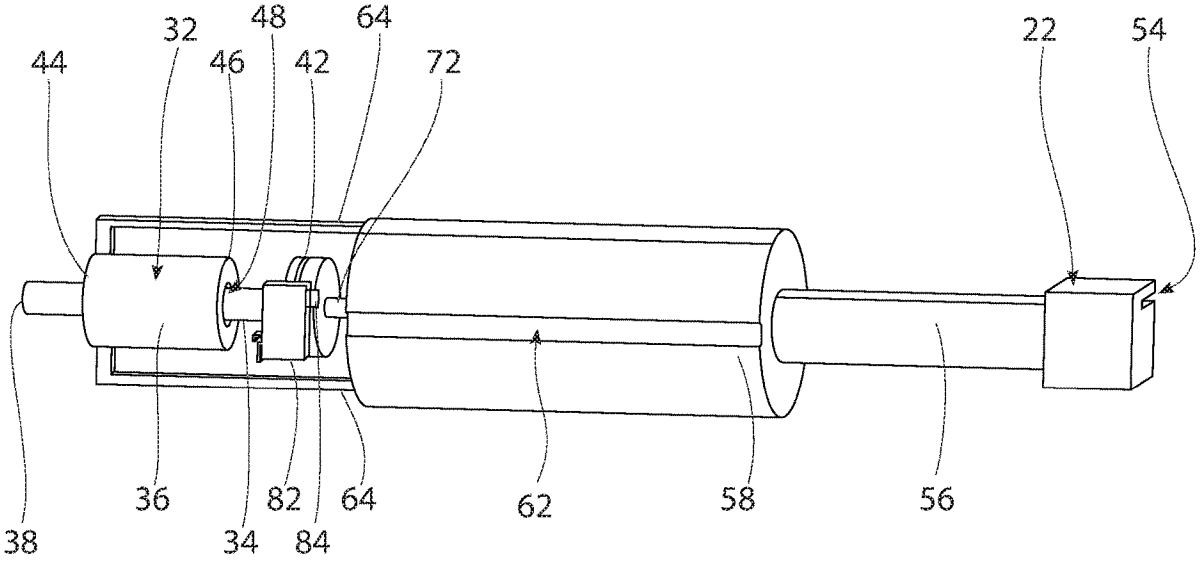
FIG. 3 is a representation of a further perspective view of the interior of the tool.
Figure 4:
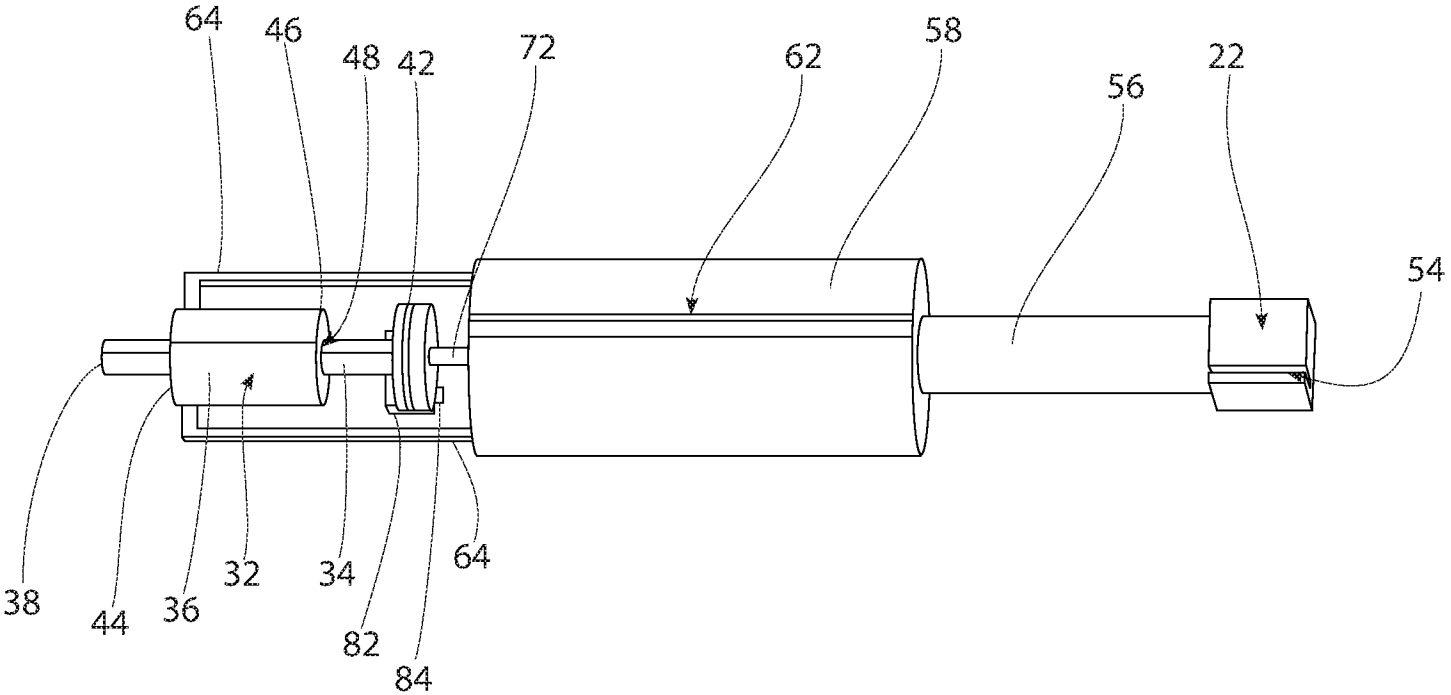
FIG. 4 is a representation of the tool of FIG. 3, rotated 180° around a center axis of the tool.

FIGS. 2 and 3 are representations of the interior of the exterior wall 24 and the interior of the body 16. The exterior wall 24 does not appear in FIGS. 2 and 3 to clearly show the components of the tool 12 contained inside the exterior wall 24 of the body 16.

A solenoid 32 is contained inside the exterior wall 24 of the body 16. The solenoid 32 is comprised of a solenoid shaft 34 and a solenoid coil 36 that surrounds the solenoid shaft. The solenoid shaft 34 has an axial length between a proximal end 38 of the solenoid shaft and a distal end 42 of the solenoid shaft. The solenoid shaft 34 has a smooth, cylindrical configuration that enables the solenoid shaft 34 to move axially through the solenoid coil 36. The solenoid shaft 34 is axially moveable through the coil 36 and in the interior of the body 16 toward the distal end 28 of the body to a first position of the solenoid shaft 34 relative to the body 16 represented in FIGS. 2 and 3, and toward the proximal end 26 of the body 16 to a second position of the solenoid shaft relative to the body. A spring (not shown) biases the solenoid shaft 34 toward the first position of the solenoid shaft relative to the body 16 represented in FIGS. 2 and 3.

The solenoid coil 36 is a wrapped coil of wire that has an axial length between a proximal end 44 of the solenoid coil 36 and a distal end 46 of the solenoid coil 36. As represented in FIGS. 2 and 3, the coil of wiring wrapped around the solenoid coil 36 forms an interior bore 48 through the solenoid coil 36 that is spaced radially from the solenoid shaft 34, enabling the solenoid shaft 34 to easily move axially through the interior bore 48.

As represented in FIG. 1, the power source 18 is connected to the body 16 at the proximal end 26 of the body. The power source 18 is contained in a housing 52 that has a cylindrical configuration and is coaxial with the center axis 14 of the tool 12. The power source housing 52 contains a rechargeable battery (not shown). The power source housing 52 is removably attached to the proximal end 26 of the body 16 to enable the power source housing 52 to be removed from the body 16 and the rechargeable battery recharged. In a further embodiment of the tool 12, the power source could be separate from the body and communicate electronically with the body through a length of electrically conductive wiring.

As represented in FIG. 1, the cable tie tension and cut device 22 is attached to the body 16 at the distal end 28 of the body 16. The cable tie tension and cut device 22 can be any known cable tie tension and cut device that can manually receive the tail of a cable tie that has been inserted through the head of the cable tie in a slot 54 of the cable tie tension and cut device 22. The cable tie tension and cut device 22 is operable to pull or tension the tail of the cable tie that has been inserted into the slot 54, and then cut the tale of the cable tie adjacent the head of the cable tie. The cable tie tension and cut device 22 is operable in response to a rod 56 of the cable tie tension and cut device being moved axially from a first position of the rod adjacent the distal end 28 of the body 16 represented in FIGS. 2 and 3, toward the proximal end 26 of the body 16.

As represented in FIGS. 2 and 3, the rod 56 of the cable tie tension and cut device 22 has a cylindrical base 58 inside the exterior wall 24 of the body 16. The base 58 has axially extending slots 62 in an exterior surface of the base 58. The axially extending slots 62 of the base 58 receive axially extending rails 64 inside the exterior wall 24 of the body 16. The rails 64 enable the rod 56 and the base 58 to move axially through the interior of the body 16. As represented in FIGS. 2 and 3, a narrow actuator shaft 72 extends into the proximal end of the base 58 and is movable through the base 58 and the rod 56 to the cable tie tension and cut device 22. Axial movement of the shaft 72 operates the cable tie tension and cut device to apply tension to a tail of a cable tie and then cut the tail. The shaft 72 is operatively connected to the distal end 42 of the solenoid shaft 34.

As stated above, the cable tie tension and cut device 22 can be any known cable tie tension and cut device that can manually receive the tail of a cable tie that has been inserted through the head of a cable tie, and is operable to pull or tension the tail of the cable tie and then cut the tail of a cable tie adjacent the head of the cable tie. An example of such a known cable tie tension and cut device is disclosed in the U.S. Patent of Moody et al., U.S. Pat. No. 3,865,156, which is incorporated herein by reference.

A switch 82 is provided inside the body 16. The switch 82 is an electric switch and has a push button actuator 84. The switch 82 is operatively, electrically connected between the power source 18 and the solenoid coil 36. The switch 82 is operable wherein, pushing the switch push button actuator 84 axially as represented in FIGS. 2 and 3, closes the switch 82. Closing the switch 82 communicates electric power from the power source 18 through the switch 82 to the coil 36 of the solenoid 32. The electric power provided to the solenoid coil 36 energizes the coil 36 and moves the solenoid shaft 34 from the first position of the solenoid shaft represented in FIGS. 2 and 3, to the left to the second position of the solenoid shaft 34. In the embodiment of the tool 12 represented in FIGS. 2 and 3, the switch 82 is positioned inside the body 16 adjacent the base 58 of the rod 56 of the cable tie tension and cut device 22. In a further embodiment of the tool 12 represented in FIG. 1, the switch 82 is positioned inside the body 16 and adjacent an opening 86 through the exterior wall 24 of the body 16 where the switch can be accessed and closed manually by pressing the switch actuator button 84 laterally or radially relative to the body 16.

In operation of the tool 12, with the tail of a cable tie wrapped around a bundle of wiring and inserted through the head of the cable tie and into the slot 54 of the cable tie tension and cut device 22, the cable tie tension and cut device 22 at the distal end of the body 16 is pressed against the head of the cable tie. Manual pushing of the cable tie tension and cut device 22 against the head of the cable tie while manually holding the tail of the cable tie inserted through the slot 54 removes any slack in the tail of the cable tie. Continued manual pushing of the cable tie tension and cut device 22 against the head of the cable tie causes the rod 56 to move from the first position of the rod represented in FIGS. 2 and 3 toward the proximal end 26 of the body 16. The continued pushing of the cable tie tension and cut device 22 against the head of the cable tie causes the rod 56 and the base 58 of the cable tie tension and cut device 22 to move toward the proximal end 26 of the body 16 until the base 58 engages against the push button actuator 84 of the switch 82, closing the switch. Closing the switch communicates electric power to the solenoid coil 36 which causes the solenoid shaft 34 to move from its first position represented in FIGS. 2 and 3, to the left to its second position. The movement of the solenoid shaft 34 moves the actuator shaft 72 of the cable tie tension and cut device 22 toward the proximal end 26 of the body 16 which activates the cable tie tension and cut device to pull the cable tie tail from the cable tie head at a predetermined force, and then cut the cable tie tail adjacent the cable tie head.

In the further embodiment of the tool 12 having the switch 82 accessible from the exterior of the body 16 represented in FIG. 1, the switch 82 is manually pressed laterally or radially relative to the body 16 of the tool 12 closing the switch 82. Again, closing the switch 82 provides electric power to the solenoid coil 36 which causes the solenoid shaft 34 to move from its first position represented in FIGS. 2 and 3 to the left toward its second position and toward the proximal end 26 of the body 16. This in turn causes the actuator shaft 72 to activate the cable tie tension and cut device 22 to pull the cable tie tail from the cable tie head at a predetermined force and then cut the cable tie tail adjacent the cable tie head.

The ergonomic disadvantage of having to squeeze a trigger on a cable tie tensioning and cutting gun possibly several thousand times during a manufacturing shift is eliminated by the cable tie tension and cutting tool of this disclosure, which has no trigger. The elimination of the trigger also eliminates the problem of wiring becoming pinched between a trigger and gun body. Also, the sharp tail portion projecting from the head of the cable tie not having all of the slack taken out of the cable tie before the tail is cut is eliminated by the construction of the tool that is the subject of this disclosure.

As various modifications could be made in the construction of the apparatus and its method of operation herein described and illustrated without departing from the scope of the invention, it is intended that all matter contained in the foregoing description or shown in the accompanying drawings shall be interpreted as illustrative rather than limiting. Thus, the breadth and scope of the present disclosure should not be limited by any of the above described exemplary embodiments, but should be defined only in accordance with the following claims appended hereto and their equivalents.

What is claimed:

1. A tool for installing a cable tie having a head and a tail extending from the head, the tool comprising:

the tool having no trigger projecting laterally from the tool;

a body having a longitudinal length between a proximal end of the body and a distal end of the body;

a switch inside the body;

a solenoid inside the body, the solenoid comprising a solenoid shaft and a solenoid coil surrounding the solenoid shaft, the solenoid coil being in electric communication with the switch, the solenoid shaft being moveable toward the distal end of the body to a first position of the solenoid shaft relative to the body and toward the proximal end of the body to a second position of the solenoid shaft relative to the body;

a cable tie tension and cut device, the cable tie tension and cut device being operatively connected to the solenoid shaft, the cable tie tension and cut device having a rod that projects from the distal end of the body, the rod being moveable away from the distal end of the body to a first position of the rod relative to the body and toward the proximal end of the body to a second position of the rod relative to the body; and, whereby, with the tail of the cable tie inserted through the head of the cable tie and into the cable tie tension and cut device, manually pushing the cable tie tension and cut device against the head of the cable tie causes the rod to move from the first position of the rod toward the proximal end of the body and causes the cable tie tension and cut device to remove any slack in the tail of the cable tie, and closing the switch provides power to the solenoid coil which causes the solenoid shaft to move from the first position to the second position which activates the cable tie tension and cut device to pull the cable tie tail from the cable tie head and then cut the cable tie tail adjacent the cable tie head.

2. The tool of claim 1, further comprising:

the body having a cylindrical configuration that extends along the longitudinal length of the body.

3. The tool of claim 2, further comprising:

a power source having a cylindrical configuration, the power source being connected to the proximal end of the body with the cylindrical configuration of the power source longitudinally aligned with the cylindrical configuration of the body.

4. The tool of claim 3, further comprising:

the rod of the cable tie tension and cut device having a cylindrical configuration, the cylindrical configuration of the rod being longitudinally aligned with the cylindrical configuration of the body.

5. The tool of claim 1, further comprising:

the body having a cylindrical configuration that extends along the longitudinal length of the body with there being no lateral protrusion from the cylindrical configuration of the body.

6. The tool of claim 1, further comprising:

the switch is positioned inside the body adjacent the rod of the cable tie tension and cut device where continued movement of the rod toward the proximal end of the body causes the rod to close the switch, thereby providing power to the solenoid coil.

7. The tool of claim 1, further comprising:

the switch is positioned in a hole on a side of the body where the switch can be manually pushed laterally into the body to close the switch.

8. A tool for installing a cable tie having a head and a tail extending from the head, the tool comprising:

the tool having no trigger projecting laterally from the tool;

a body having a longitudinal length between a proximal end of the body and a distal end of the body;

a switch inside the body;

a power source in electric communication with the switch, the power source having a longitudinal length that is aligned with the longitudinal length of the body;

a solenoid inside the body, the solenoid comprising a solenoid shaft and a solenoid coil surrounding the solenoid shaft, the solenoid coil being in electric communication with the switch, the solenoid shaft being moveable toward the distal end of the body to a first position of the solenoid shaft relative to the body and toward the proximal end of the body to a second position of the solenoid shaft relative to the body;

a cable tie tension and cut device, the cable tie tension and cut device being operatively connected to the solenoid shaft, the cable tie tension and cut device having a rod that projects from the distal end of the body, the rod having a longitudinal length that is aligned with the longitudinal length of the body, the rod being moveable away from the distal end of the body to a first position of the rod relative to the body and toward the proximal end of the body to a second position of the rod relative to the body; and, whereby, with the tail of the cable tie tail inserted through the head of the cable tie and into the cable tie tension and cut device, manually pushing the cable tie tension and cut device against the head of the cable tie causes the rod to move from the first position of the rod toward the proximal end of the body and causes the cable tie tension and cut device to remove any slack in the tail of the cable tie, and closing the switch provides power to the solenoid coil which causes the solenoid shaft to move from its first position to its second position which activates the cable tie tension and cut device to pull the cable tie tail from the cable tie head and then cut the cable tie tail adjacent the cable tie head.

9. The tool of claim 8, further comprising:

the body having a cylindrical configuration that extends along the longitudinal length of the body.

10. The tool of claim 9, further comprising:

the power source having a cylindrical configuration, the power source being connected to the proximal end of the body with the cylindrical configuration of the power source longitudinally aligned with the cylindrical configuration of the body.

11. The tool of claim 10, further comprising:

the rod of the cable tie tension and cut device having a cylindrical configuration, the cylindrical configuration of the rod being longitudinally aligned with the cylindrical configuration of the body.

12. The tool of claim 8, further comprising:

the body having a cylindrical configuration that extends along the longitudinal length of the body with there being no lateral protrusion from the cylindrical configuration of the body.

13. The tool of claim 8, further comprising:

the switch is positioned inside the body adjacent the rod of the cable tie tension and cut device where continued movement of the rod toward the proximal end of the body causes the rod to close the switch, thereby providing power to the solenoid coil.

14. The tool of claim 8, further comprising:

the switch is positioned in a hole on a side of the body where the switch can be manually pushed laterally into the body to close the switch.

15. A method of tensioning a tail of a cable tie inserted through a head of the cable tie and then cutting the tail of the cable tie adjacent the head of the cable tie, the method comprising:

positioning the tail of the cable tie that has been inserted through the head of the cable tie into a cable tie tension and cut device at a distal end of a tool for installing cable ties;

manually pushing the cable tie tension and cut device against the head of the cable tie causing a rod of the tool for installing cable ties to move toward a proximal end of the tool for installing cable ties which causes the cable tie tension and cut device to remove any slack in the tail of the cable tie inserted through the head of the cable tie; and, closing a switch of the tool for installing cable ties which provides power to a linear actuator of the tool for installing cable ties that in turn causes a shaft of the linear actuator that is operatively connected to the cable tie tension and cut device to move toward the proximal end of the tool for installing cable ties which activates the cable tie tension and cut device to pull the cable tie tail from the cable tie head and then cut the cable tie tail adjacent the cable tie head.

16. The method of claim 15, further comprising:

the linear actuator being a solenoid and the shaft of the linear actuator being a solenoid shaft.

17. The method of claim 16, further comprising:

closing the switch of the tool for installing cable ties by engaging an actuator of the switch with the rod of the tool for installing cable ties as the rod is moved toward the proximal end of the tool for installing cable ties.

18. The method of claim 16, further comprising:

closing the switch by manually engaging a button actuator of the switch.

* * * * *